US006116745A

United States Patent [19]

Yei

[11] Patent Number: 6,116,745

[45] Date of Patent: Sep. 12, 2000

[54] GARMENT WITH AN ELECTROLUMINESCENT CIRCUIT

[75] Inventor: Wu Yong Yei, Tsuen Wan, The Hong Kong Special Administrative Region of the People's Republic of China

[73] Assignee: Gordon Industries Ltd., New York, N.Y.

[21] Appl. No.: 09/184,256

[22] Filed: Nov. 2, 1998

[51] Int. Cl.[7] ..... F21L 15/14

[52] U.S. Cl. ..... 362/105; 362/106; 362/84

[58] Field of Search ..... 362/84, 105, 106, 362/103; 313/502, 510, 512

[56] References Cited

U.S. PATENT DOCUMENTS

| | | | |
|---|---|---|---|
| 5,067,063 | 11/1991 | Grannenman | 362/156 |
| 5,794,366 | 8/1998 | Chien | 40/540 |
| 5,829,063 | 11/1998 | Cheng | 2/209.13 |
| 5,845,987 | 12/1998 | Painter | 362/206 |
| 5,977,720 | 11/1999 | Pace | 315/169.3 |

*Primary Examiner*—Sandra O'Shea
*Assistant Examiner*—Hargobind S. Sawhney
*Attorney, Agent, or Firm*—Ezra Sutton

[57] ABSTRACT

An illuminated display panel for a garment including an electroluminescent circuit having an electrical microchip, a plurality of resistors, a plurality of semiconductor rectifiers, and an electroluminescent display element, all being connected to the electrical microchip; and a battery compartment with miniature flat batteries contained therein. The illuminated display panel for a garment further includes a display label having indicia thereon and being attached to the electroluminescent display element by gluing, stitching, sewing, stapling, epoxy, cementing or combinations thereof. The electroluminescent display element is attached to the garment by gluing, stitching, sewing, stapling, epoxy cementing or combinations thereof. The electroluminescent display element is electrically connected to the electroluminescent circuit by one or more soldered connection points; and a pair of connection wires electrically connects the one or more soldered connection points to the electroluminescent circuit.

13 Claims, 4 Drawing Sheets

GARMENT WITH AN ELECTROLUMINESCENT CIRCUIT

FIELD OF THE INVENTION

This invention relates to garments having an electroluminescent circuit for use as a sign for displaying indicia, such as a business name, trademark, logo or novelty statement. More particularly, the electroluminescent circuit provides an illuminated display adaptable for use with any type of clothing article, such as hats, baseball caps, jackets, shirts, backpacks, tote bags, camping gear and the like.

BACKGROUND OF THE INVENTION

Many types of clothing articles have signs, displays, panels, advertisement buttons, stickers which are illuminated by electrical or electronic means and are well known in the prior art. In general, the prior art has disclosed several structures and designs of illuminated display panels for clothing that use laser emitting diodes (LEDs), miniature incandescent light bulbs, and electroluminescent (EL) lamps for producing the needed illumination.

Display signs using LEDs or miniature incandescent bulbs are usually bulky, heavy for that particular type of clothing article and the mounting structure of the display sign often protrudes from the surface of the clothing article in which a potential for electrical and other hazards can develop (i.e. broken bulbs or LEDs cutting the wearer, garments that catch on fire, etc.). Additionally, the display panels typically contain electrical wires, circuit boards, and a power source being batteries. The batteries are also bulky and heavy and tend to make that particular clothing article unappealing and unaesthetic when worn by the user.

Current display signs using ELs within their clothing articles usually have circuit board components, a power source using AAA batteries making the clothing article a heavier and bulkier, and a display area that has a submarine style window giving an unaesthetic look to that particular type of clothing article to be worn by the wearer.

There remains a need for a garment with an electroluminescent (EL) circuit that operates using miniature batteries, a miniature circuit board having fewer electronic components than previously made EL circuits, and a simpler display panel area which better utilizes the electroluminescent element for the display panel area being illuminated.

DESCRIPTION OF THE PRIOR ART

Clothing articles having illuminated display panels, signs and the like using LEDs, incandescent bulbs and EL lamps of various designs, structures and styles have been disclosed in the prior art. For example, U.S. Pat. No. 4,999,936 to CALAMIA et al discloses an illuminated sign that produces a luminescent display being suitable for attachment to an article of clothing such as a jacket or cap. The illuminated sign includes an electroluminescent lamp that produces a luminescent cool light, in white, yellow, green or blue, that is visible through the openings of an indicia stencil affixed to the front of the lamp.

U.S. Pat. No. 4,709,307 to BRANDON discloses an illuminated article of clothing that uses light-emitting diodes (LEDs) to achieve the ornamental lighting pattern. The LEDs are mounted on a printed wiring board that comprises one element of a five element structure that is attached to the article of clothing. A battery is provided for illuminating the LEDs as is a control circuit for controlling the energization of the LEDs. A cable, hidden within the article of clothing, is used to electrically connect the battery power to the LEDs.

U.S. Pat. No. 4,570,206 to DEUTSCH discloses an article of clothing that includes a flexible panel having a plurality of holes selected to form a pattern. Through the plurality of holes project a similar plurality of electrically illuminable members such as LEDs. The LEDs are connected through a flexible cable to an electrical power source consisting of a battery and complimentary control.

U.S. Pat. No. 4,231,079 to HEMINOVER discloses a hat assembly having a plurality of perforations located over the upper portion of the hat. Into the perforations is inserted an equal plurality of LEDs that project through the perforations for viewing. A power and control circuit is included to energize the LEDs sequentially at a rate to optically simulate motion.

U.S. Pat. No. 4,164,008 to MILLER discloses a garment having a plurality of holes into which is inserted and protrudes an equal plurality of LEDs. The LEDs are mounted on a printed circuit board that is attached at the rear of the garment. A circuit separate from the printed circuit board is provided that controls and powers the LEDs.

None of the prior art patents disclose the structure and design of an electroluminescent (EL) circuit used within a garment as depicted in the present invention.

Accordingly, it is an object of the present invention to provide a garment with an electroluminescent (EL) circuit that is durable, light-weight, streamline (unbulky), compact and aesthetic in appearance for use in a variety of clothing articles that include hats, baseball caps, jackets, shirts, T-shirts, athletic outerwear, sweatshirts, shorts, jeans, backpacks, tote bags, camping gear and the like.

Another object of the present invention is to provide a garment with an EL circuit that has a miniaturized circuit board with a minimal amount of component circuitry therein for reducing the weight of the illuminated garment, therefore making the illuminated garment more comfortable to wear.

Another object of the present invention is to provide a garment with an EL circuit that uses miniaturized batteries as a power source for reducing the weight of the illuminated garment, therefore making the illuminated garment more streamline, less bulky and more aesthetic looking when in use by the wearer.

Another object of the present invention is to provide a garment with an EL circuit that uses an embroidered (stenciled) patch on top of the EL element for providing a more pleasant and aesthetic appearance for illuminating the garment when in use by the wearer.

Another object of the present invention is to provide a garment with an EL circuit that is not size limiting and is reliable, maintenance free, and is easy to use and control.

A further object of the present invention is to provide a garment with an EL circuit that can be mass produced in an automated and economical manner and is readily affordable by the user.

SUMMARY OF THE INVENTION

The present invention provides for an illuminated display panel for a garment including an electroluminescent circuit having an electrical microchip, a plurality of resistors, a plurality of semiconductor rectifiers, and an electroluminescent display element, all being connected to the electrical microchip; and a battery compartment with miniature flat batteries contained therein. The illuminated display panel for a garment further includes a display label having indicia thereon and being attached to the electroluminescent display element by gluing, stitching, sewing, stapling, epoxy, cementing or combinations thereof. The electroluminescent display element is attached to the garment by gluing, stitching, sewing, stapling, epoxy, cementing or combinations thereof. The electroluminescent display element is electrically connected to the electroluminescent circuit by one or more soldered connection points; and a pair of connection wires electrically connects the one or more soldered connection points to the electroluminescent circuit.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
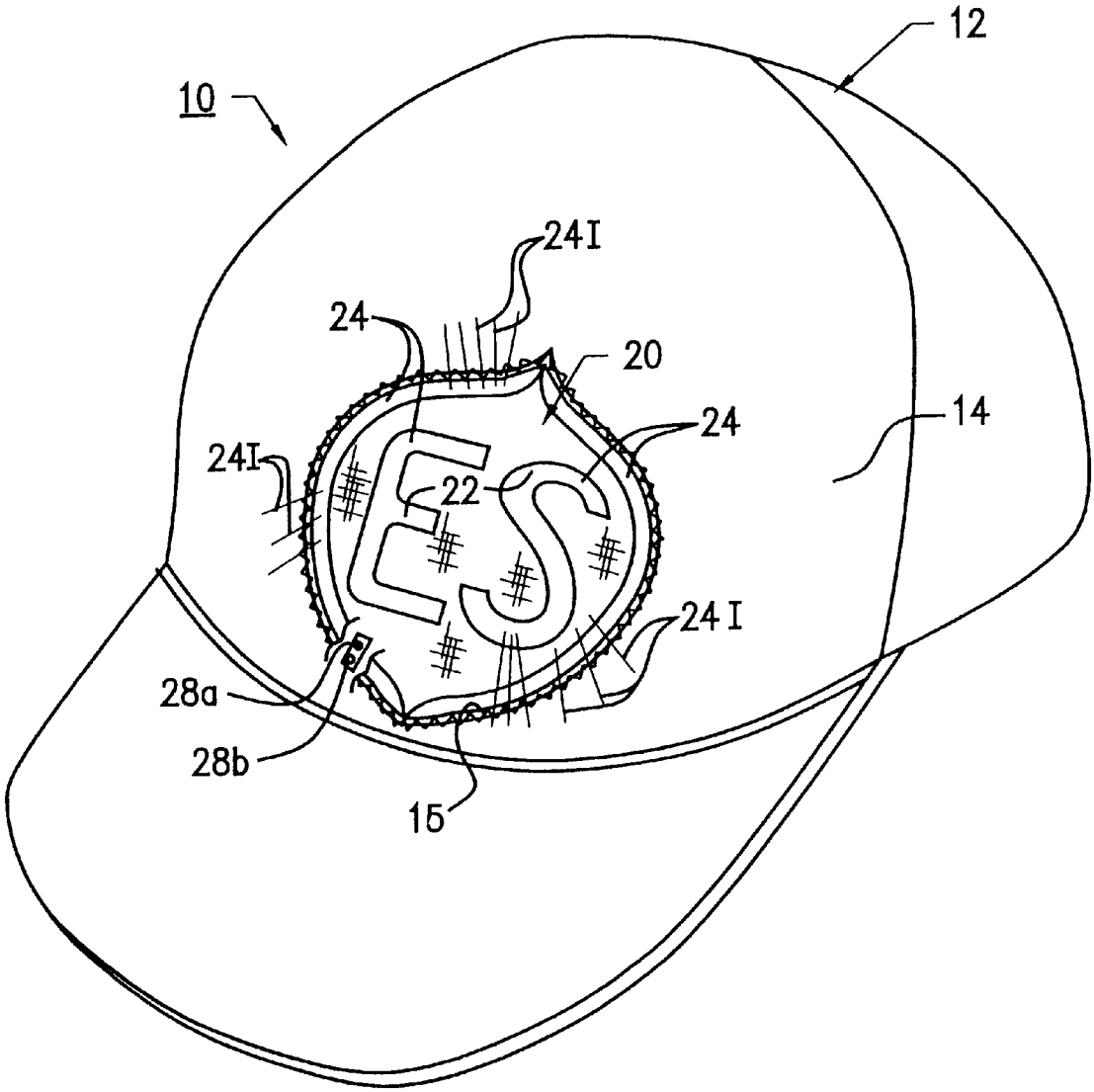
FIG. 1 is a front perspective view of a garment with an EL circuit of the preferred embodiment of the present invention showing a baseball cap as the garment having an embroidered stenciled patch with indicia thereon, the EL display element having electrical connection points thereon, and shown in operational use.
Figure 2:
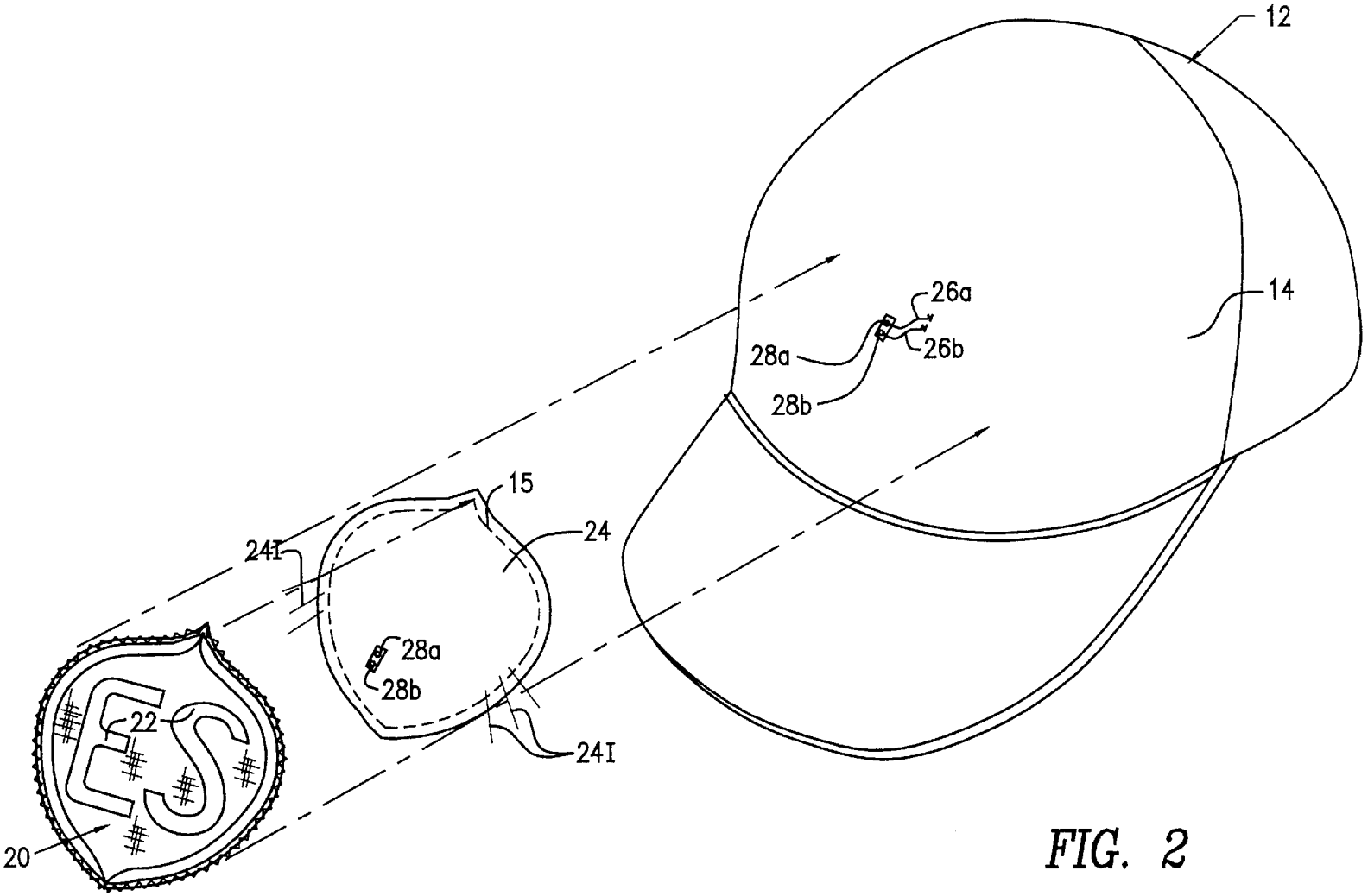
FIG. 2 is an exploded front perspective view of a garment with an EL circuit of the present invention showing the front wall of the baseball cap, showing the EL display element, the embroidered stencil patch with indicia thereon, being connected to the front wall of the baseball cap.

A garment with an electroluminescent (EL) circuit 10 and its component parts of the preferred embodiment of the present invention are represented in detail by FIGS. 1 through 4 of the drawings. The garment with an EL circuit 10 includes an embroidered stenciled patch or display label 20 with indicia 22 thereon on top of and connected to an EL display element 24 for producing a color illumination 24I, such as yellow, red, green, blue, orange, pink, white light, etc. The EL display element 24 is connected to the front wall surface 14 of the baseball style cap 12 by means of staples, glue, or stitching 15, as shown in FIGS. 1 and 2 of the drawings. The EL display element 24 is electrically connected to a pair of connection wires 26*a* and 26*b* at electrical connection points 28*a* and 28*b*, respectively, as depicted in FIGS. 1 and 2 of the drawings. The electrical connection points 28*a* and 28*b* may be in the form of soldered connection points. Connection wires 26*a* and 26*b* connect the EL display element 24 to the electrical circuit board 30.

Figure 3:
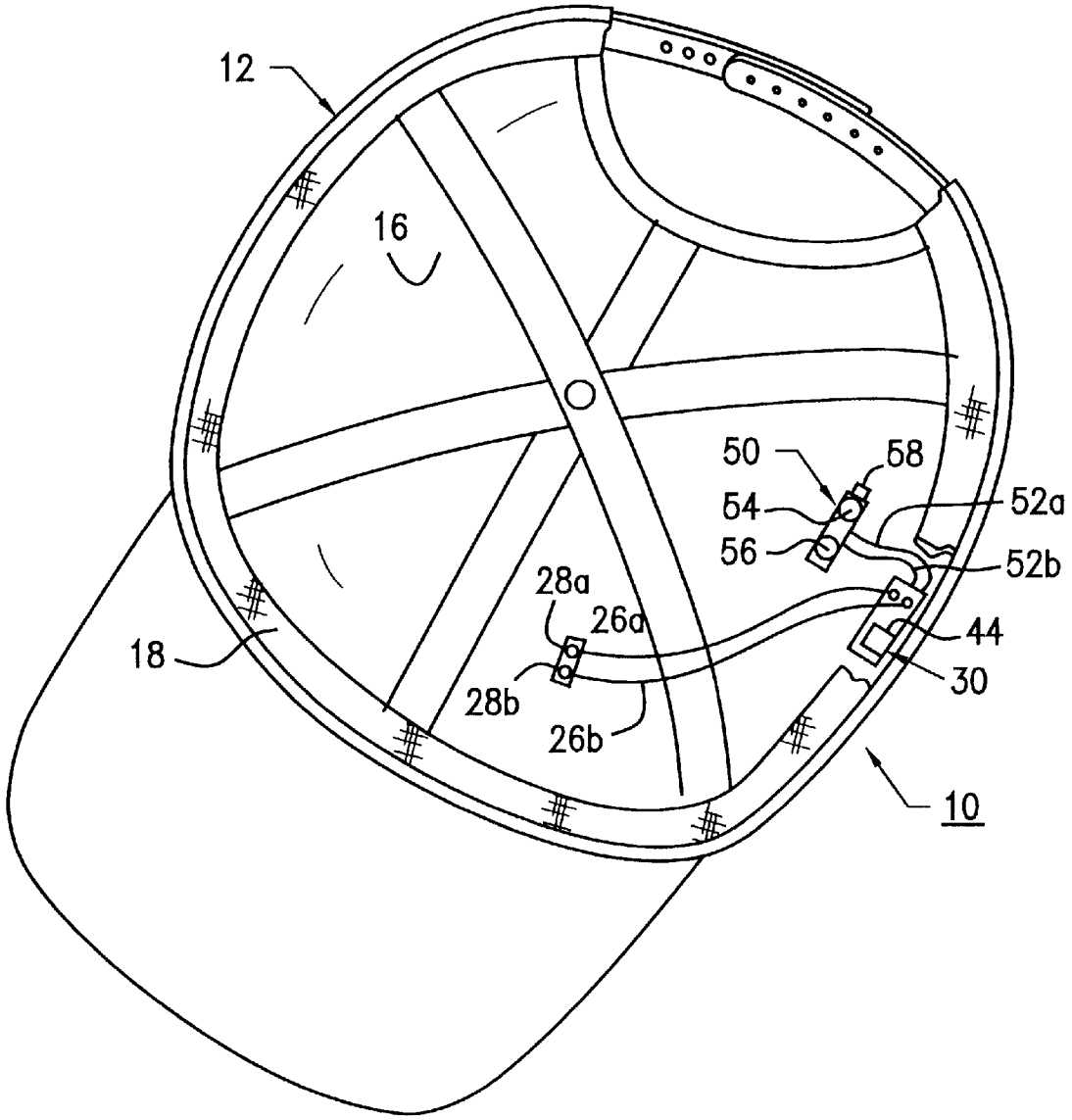
FIG. 3 is a rear perspective view of a garment with an EL circuit of the present invention showing the interior area of the baseball cap garment having therein the EL circuit board with electrical connection wires and the battery compartment with miniaturized batteries and an ON/OFF button, and shown in operational use.
Figure 4:
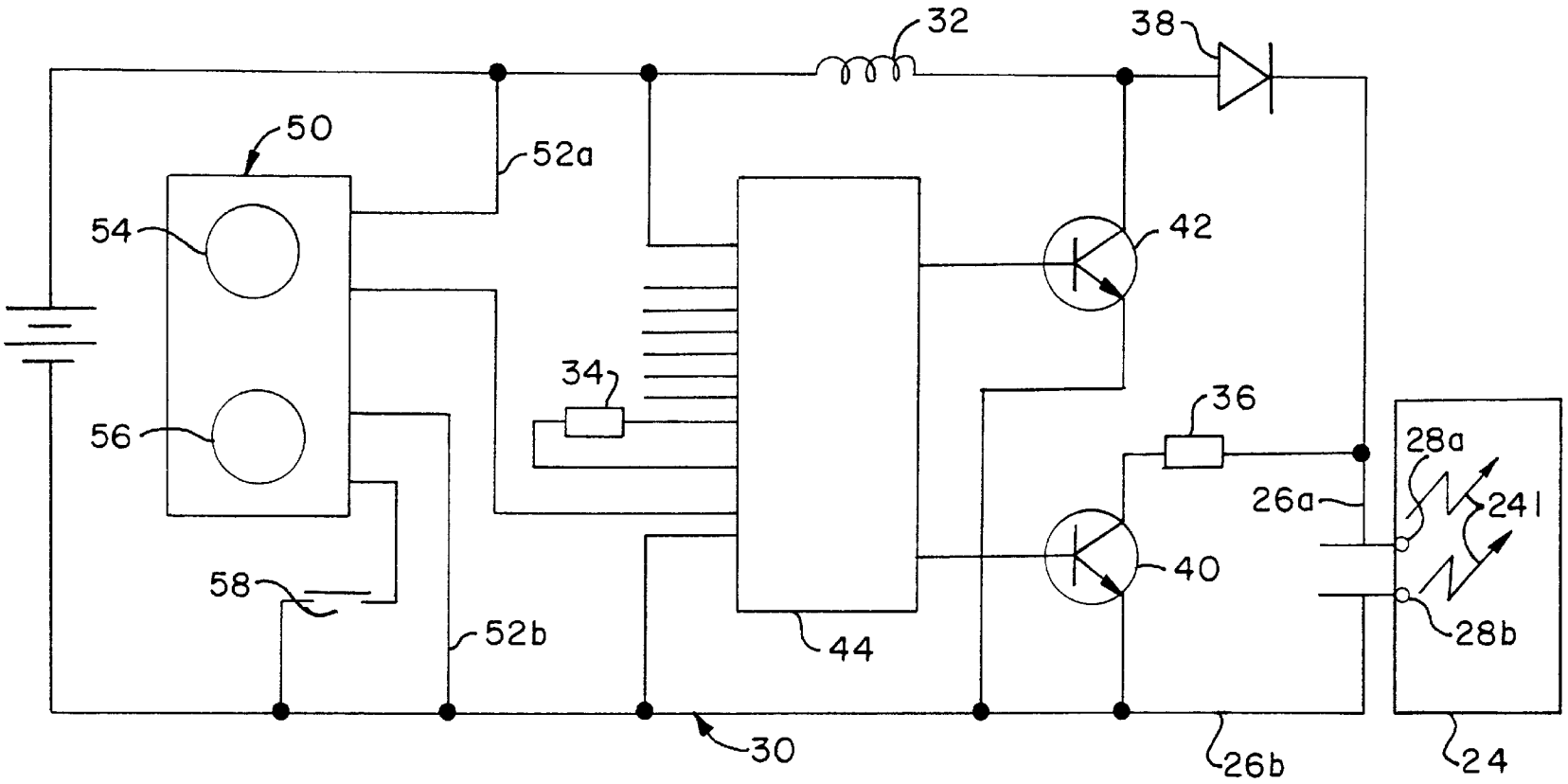
FIG. 4 is a schematic diagram of a garment with an EL circuit of the present invention showing the electrical circuit board, the battery compartment with batteries, and the electrical connection wires connected to the EL display element.

The electrical circuit board 30 includes first, second and third resistor components 32, 34 and 36 and first, second and third semiconductor rectifier components 38, 40 and 42 for shunting the electrical current in one direction, all being electrically connected to the miniaturized electrical microchip 44, as depicted in FIGS. 3 and 4 of the drawings. The electrical circuit board 30 is electrically connected to the battery compartment 50 via a pair of connection wires 52*a* and 52*b*. The battery compartment 50 includes a pair of miniaturized batteries 54 and 56 such as watch batteries, hearing-aid batteries and the like, and an ON/OFF button or switch 58 therein. The electrical connection wires 26*a*, 26*b*, 52*a* and 52*b*, the electrical circuit board 30 and the battery compartment 50 with ON/OFF button 58 are all located and held in position on the interior wall surface 16 and beneath the interior band/rim 18 of the baseball style cap 12 by means of glue, epoxy cement or the like, as depicted in FIG. 3 of the drawings.

The electrical circuit board 30 is designed to have a streamline configuration having dimensions of 25 mm in length, 15 mm in width, and 2.5 mm in thickness. The battery compartment 50 with batteries 54 and 56 therein is also designed to have a streamline configuration having dimensions of 35 mm in length, 12 mm in width, and 5 mm in thickness. These streamline configurations of the electrical circuit board 30 and the battery compartment 50 are manufactured to provide various garments the ability of reducing the overall weight and size of that garment, therefore making that illuminated garment more streamline, less bulky and more aesthetic looking when in use by the wearer.

OPERATION OF THE PRESENT INVENTION

A garment with an EL circuit 10 can be placed on various surfaces of many types of garments and accessories, such as hats, baseball caps 12, pants, shorts, jackets, T-shirts, shirts, sports apparel, camping gear, backpacks, tote bags and the like. The placement and location of the circuit board 30 and battery compartment 50 within the garment is dependent upon the type of clothing article and the material of the garment being used. The use of the garment with an EL circuit 10 does not interfere with the function of the garment used nor with its aesthetic appearance because of the light-weight, compact and streamline component parts 30 and 50 being utilized.

The artwork and advertisement embroidered stenciled patches 20 with indicia 22 thereon can be of any size and style. The cutout(s) on the indicia stenciled patch 20 has an image displayed via the light/illumination 24I produced by EL display element 24 attached to the outer wall surface 14 of the garment 12.

In using the garment with an EL circuit 10 the wearer simply turns "ON" the ON/OFF button 58 which then activates the batteries 54 and 56 and the electrical microchip 44 of circuit board 30 for the projection of light/illumination 24I from the EL display element 24. When the wearer is finished using the garment (i.e. baseball cap 12), the wearer simply turns the ON/OFF button 58 to the "OFF" position.

ADVANTAGES OF THE PRESENT INVENTION

Accordingly, an advantage of the present invention is that it provides for a garment with an electroluminescent (EL) circuit that is durable, light-weight, streamline (unbulky), compact and aesthetic in appearance for use in a variety of clothing articles that include hats, baseball caps, jackets, shirts, T-shirts, athletic outerwear, sweatshirts, shorts, jeans, backpacks, tote bags, camping gear and the like.

Another advantage of the present invention is that it provides for a garment with an EL circuit that has a miniaturized circuit board with a minimal amount of component circuitry therein for reducing the weight of the illuminated garment, therefore making the illuminated garment more comfortable to wear.

Another advantage of the present invention is that it provides for a garment with an EL circuit that uses miniaturized batteries as a power source for reducing the weight of the illuminated garment, therefore making the illuminated garment more streamline, less bulky and more aesthetic looking when in use by the wearer.

Another advantage of the present invention is that it provides for a garment with an EL circuit that uses an embroidered (stenciled) patch on top of the EL element for providing a more pleasant and aesthetic appearance for illuminating the garment when in use by the wearer.

Another advantage of the present invention is that it provides for a garment with an EL circuit that is not size limiting, and is reliable, maintenance free, and is easy to use and control.

A further advantage of the present invention is that it provides for a garment with an EL circuit that can be mass produced in an automated and economical manner and is readily affordable by the user.

A latitude modification, change and substitution is intended in the foregoing disclosure, and in some instances, some features of the invention will be employed without corresponding use of other features. Accordingly it is appropriate that the appended claims be construed broadly and in a manner consistent with the spirit and scope of the invention herein.

What is claimed is:

1. An illuminated display panel for a garment, comprising:

a) an electroluminescent circuit including an electrical microchip, a plurality of resistors, a plurality of semiconductor rectifiers, and an electroluminescent display element, all being connected to said electrical microchip;

b) power source means being a battery compartment for receiving batteries therein; said power source means being connected to said electroluminescent circuit;

c) a display label having indicia thereon and being attached to said electroluminescent display element by first attachment means; said display label including an embroidered stenciled patch having openings therein for receiving therethrough the illumination from said electroluminescent display element;

d) second attachment means for attaching said electroluminescent display element to the garment; and e) first means for electrically connecting said electroluminescent display element to said electroluminescent circuit.

2. A display panel for a garment in accordance with claim 1, wherein said power source means include one or more miniaturized watch batteries for supplying power to said electroluminescent circuit.

3. A display panel for a garment in accordance with claim 1, wherein said first attachment means for attaching said display label to said electroluminescent display element includes stitching, gluing, stapling, epoxy, cementing or combinations thereof.

4. A display panel for a garment in accordance with claim 1, wherein said second attachment means for attaching said electroluminescent display element to the garment includes stitching, gluing, stapling, epoxy, cementing or combinations thereof.

5. A display panel for a garment in accordance with claim 1, wherein first means for electrically connecting said electroluminescent display element to said electroluminescent circuit include one or more soldered connection points.

6. A display panel for a garment in accordance with claim 5, wherein said electroluminescent circuit further includes a first pair of connection wires and said one or more soldered connection points; said first pair of connection wires being electrically connected to said one or more soldered connection points.

7. A display panel for a garment in accordance with claim 2, wherein said battery compartment includes two of said miniaturized watch batteries.

8. A display panel for a garment in accordance with claim 1, wherein said battery compartment includes a second pair of connection wires; said second pair of connection wires for electrically connecting said battery compartment to said electroluminescent circuit.

9. A display panel for a garment in accordance with claim 1, wherein said electroluminescent circuit has physical dimensions of 25 mm in length, 15 mm in width, and 2.5 mm in thickness for providing a streamline configuration thereto.

10. A display panel for a garment in accordance with claim 1, wherein said battery compartment has physical dimensions of 35 mm in length, 12 mm width, and 5 mm in thickness for providing a streamline configuration thereto.

11. A display panel for a garment in accordance with claim 1, where said garment is selected from the group consisting of hats, baseball caps, ski hats, helmets, shorts, pants, jeans, jackets, T-shirts, shirts, sweatshirts, sporting apparel, ski apparel, camping gear, backpacks, tote bags, and fanny packs.

12. An illuminated display panel for a garment, comprising:

a) an electroluminescent circuit including an electrical microchip, a plurality of resistors, a plurality of semiconductor rectifiers, and an electroluminescent display element, all being connected to said electrical microchip;

b) power source means being a battery compartment for receiving batteries therein; said power source means being connected to said electroluminescent circuit;

c) a display label having indicia thereon and being attached to said electroluminescent display element by first attachment means; said display label being a cutout form of letters or other indicia having an embroidered stenciled patch having openings therein for receiving therethrough the illumination produced by said electroluminescent display element;

d) second attachment means for attaching said electroluminescent display element to the garment; and e) first means for electrically connecting said electroluminescent display element to said electroluminescent circuit.

13. A display panel for a garment in accordance with claim 1, wherein said power source means include one or more miniaturized watch batteries for supplying power to said electroluminescent circuit.

* * * * *